US009277332B2

(12) United States Patent
Ku et al.

(10) Patent No.: US 9,277,332 B2
(45) Date of Patent: Mar. 1, 2016

(54) HEARING APPARATUS INCLUDING COIL OPERABLE IN DIFFERENT OPERATION MODES

(71) Applicant: Samsung Electronics Co., Ltd., Suwon-si (KR)

(72) Inventors: Yun Seo Ku, Seoul (KR); Jong Jin Kim, Hwaseong-si (KR); Jun Whon Uhm, Anyang-si (KR); Chang Wook Yoon, Seoul (KR); Dong Wook Kim, Seoul (KR); Jun Il Sohn, Yongin-si (KR); Jong Min Choi, Seoul (KR); Jong Hee Han, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/253,007

(22) Filed: Apr. 15, 2014

(65) Prior Publication Data

US 2014/0307902 A1 Oct. 16, 2014

(30) Foreign Application Priority Data

Apr. 16, 2013 (KR) ..... 10-2013-0041461

(51) Int. Cl.
*H04R 25/00* (2006.01)

(52) U.S. Cl.
CPC ..... *H04R 25/30* (2013.01); *H04R 25/554* (2013.01); *H04R 25/43* (2013.01); *H04R 2225/31* (2013.01)

(58) Field of Classification Search
CPC ..... H04R 11/00; H04R 17/00; H04R 25/43; H04R 25/60; H04R 25/65; H04R 25/70; H04R 25/356; H04R 25/456; H04R 25/554; H04R 25/556; H04R 25/558; H04R 25/505; H04R 25/602; H04R 25/606; H04R 25/652; H04R 2225/021; H04R 2225/025; H04R 2225/31; H04R 2225/41; H04R 2225/51; H04R 2225/52; H04R 2225/61; H04R 2225/63; H04R 2225/67; H04R 2460/03; H04R 2460/13; H04R 25/30
USPC ..... 381/312, 315, 323, 326, 328, 330, 331
See application file for complete search history.

(56) References Cited

U.S. PATENT DOCUMENTS

| | | | | |
|---|---|---|---|---|
| 6,498,455 | B2 | 12/2002 | Zink et al. | |
| 7,369,671 | B2 | 5/2008 | Sacha et al. | |
| 8,644,542 | B2 * | 2/2014 | Klemenz et al. | 381/323 |
| 2004/0052392 | A1 | 3/2004 | Sacha et al. | |

(Continued)

FOREIGN PATENT DOCUMENTS

| | | | |
|---|---|---|---|
| JP | 2008-178680 | A | 8/2008 |
| JP | 2009-21910 | A | 1/2009 |

(Continued)

OTHER PUBLICATIONS

Extended European Search Report issued on Jun. 24, 2014, in counterpart European Application No. 13193228.7 (7 Pages, in English).

*Primary Examiner* — Brian Ensey
(74) *Attorney, Agent, or Firm* — NSIP Law

(57) ABSTRACT

A hearing apparatus includes a coil and a coil operation mode selector configured to select either a first coil operation mode for communicating with a wireless communication terminal, or a second coil operation mode for wirelessly charging a battery of the hearing apparatus.

19 Claims, 7 Drawing Sheets

(56) References Cited

U.S. PATENT DOCUMENTS

| | | | | |
|---|---|---|---|---|
| 2008/0205678 | A1 | 8/2008 | Boguslavskij et al. | |
| 2009/0285426 | A1 | 11/2009 | Boguslavskij | |
| 2011/0311084 | A1* | 12/2011 | Drader | 381/315 |
| 2012/0109256 | A1 | 5/2012 | Meskins et al. | |

FOREIGN PATENT DOCUMENTS

| | | | |
|---|---|---|---|
| KR | 1999-0081845 | A | 11/1999 |
| KR | 10-2005-0039445 | A | 4/2005 |
| KR | 10-2009-0032074 | A | 3/2009 |

* cited by examiner

HEARING APPARATUS INCLUDING COIL OPERABLE IN DIFFERENT OPERATION MODES

CROSS-REFERENCE TO RELATED APPLICATIONS

This application claims the benefit under 35 USC 119(a) of Korean Patent Application No. 10-2013-0041461 filed on Apr. 16, 2013, in the Korean Intellectual Property Office, the entire disclosure of which is incorporated herein by reference for all purposes.

BACKGROUND

1. Field

The following description relates to a hearing apparatus including a coil switchable between a communication mode for transmitting a phone sound and a charge mode forcharging the hearing apparatus.

2. Description of Related Art

Recently, some types of hearing apparatus have been equipped with a nickel metal hydride (Ni-MH) secondary battery and may be charged wirelessly from an external device. Such a hearing apparatus needs a coil or an antenna pattern formed on a printed circuit board (PCB) to wirelessly receive power from the external device. The hearing apparatus may be wirelessly supplied with the power from the external device using a current induction method.

The hearing apparatus may include a coil for transmitting a phone sound of a phone to a hearing loss patient. The coil may transmit the phone sound to the hearing loss patient using a current induction method.

In the conventional art, the hearing apparatus must include both a coil for a wireless charging function and a separate coil for a phone sound transmission function. This increases a cost of the materials of the hearing apparatus, and makes it difficult to reduce the size of the hearing apparatus,

SUMMARY

In one general aspect, a hearing apparatus includes a coil; and a coil operation mode selector configured to select either a first coil operation mode for communicating with a wireless communication terminal, or a second coil operation mode for wirelessly charging a battery of the hearing apparatus.

The apparatus may further include a communication path selector configured to select either a first communication path configured to transmit a phone sound of the wireless communication terminal using current induction, or a second communication path configured to transmit the phone sound of the wireless communication terminal using acoustic communication.

The hearing apparatus may further include a battery operation mode selector configured to select either a first battery operation mode for charging the battery, or a second battery operation mode for discharging the battery.

The coil may be configured to generate a current using a current induction method or a resonance method in response to power wirelessly transmitted by a power supply device.

The coil may be configured to generate the current using the resonance method; and the hearing apparatus may further include a charger configured to perform impedance matching to enable resonance to occur between the coil of the hearing apparatus and a coil of the power supply device.

The hearing apparatus may further include a processor configured to generate a control signal to control the coil operation mode selector.

The hearing apparatus may further include a sensor configured to sense recognition information indicating whether wireless charging of the hearing apparatus is to be performed; and the processor may be further configured to generate the control signal based on the sensed recognition information.

The recognition information may indicate whether a charging control of the hearing apparatus has been manually actuated.

The recognition information may indicate whether a power supply device configured to wirelessly supply power to the hearing apparatus is operating.

The recognition information may indicate whether the hearing apparatus has remained motionless for a predetermined time.

The hearing apparatus may further include a monitor configured to generate a control signal to control the coil operation mode selector based on a current signal generated by the coil.

The monitor may be further configured to generate the control signal based on a reference value for distinguishing whether the current signal is a current signal for transmitting a phone sound, or a current signal for charging the battery.

In another general aspect, the hearing apparatus includes a coil; a coil operation mode selector configured to select either a first coil operation mode for communicating with a wireless communication terminal, or a second coil operation mode for wirelessly charging a battery of the hearing apparatus; a communication path selector configured to select either a first communication path configured to transmit a phone sound of the wireless communication terminal using current induction, or a second communication path configured to transmit the phone sound of the wireless communication terminal using acoustic communication; and a battery operation mode selector configured to select either a first battery operation mode for charging the battery, or a second battery operation mode for discharging the battery.

The coil may be configured to generate a current using a current induction method or a resonance method in response to power wirelessly transmitted by a power supply device.

The coil may be configured to generate the current using the resonance method; and the hearing apparatus may further include a charger configured to perform impedance matching to enable resonance to occur between the coil of the hearing apparatus and a coil of the power supply device.

The hearing apparatus may further include a processor configured to generate a control signal to control the coil operation mode selector.

The hearing apparatus may further include a sensor configured to sense recognition information indicating whether wireless charging of the hearing apparatus is to be performed; and the processor may be further configured to generate the control signal based on the sensed recognition information.

The recognition information may indicate whether a charging control of the hearing apparatus has been manually actuated, or whether a power supply device configured to wirelessly supply power to the hearing apparatus is operating, or whether the hearing apparatus has remained motionless for a predetermined time.

The hearing apparatus may further include a monitor configured to generate a control signal to control the coil operation mode selector based on a current signal generated by the coil.

The monitor may be further configured to generate the control signal based on a reference value for distinguishing whether the current signal is a current signal for transmitting a phone sound, or a current signal for charging the battery.

In another general aspect, an apparatus includes a coil; and a mode selector configured to select either a communicating mode for communicating using the coil, or a charging mode for charging using the coil.

The coil may be configured to generate a current signal in response to a current generated in a speaker of a communication terminal using a current induction method; and the apparatus may further include a microphone configured to generate a current signal in response to an acoustic sound received from the speaker of the communication terminal; and a path selector configured to select either the current signal generated by the coil, or the current signal generated by the microphone.

The coil may be configured to receive power wirelessly transmitted from a power supply device using a current induction method or a resonance method; and the apparatus may further include a battery; and a charger configured to receive charge the battery with the power received by the coil.

The apparatus may further include a supplier configured to receive power from the battery and supply the received power to the apparatus; and a mode selector configured to select either a charging mode in which the charger is connected to the battery to charge the battery, or a discharging mode in which the supplier is connected to the battery to discharge the battery by supplying the received power to the apparatus.

Other features and aspects will be apparent from the following detailed description, the drawings, and the claims.

DETAILED DESCRIPTION

Figure 1:
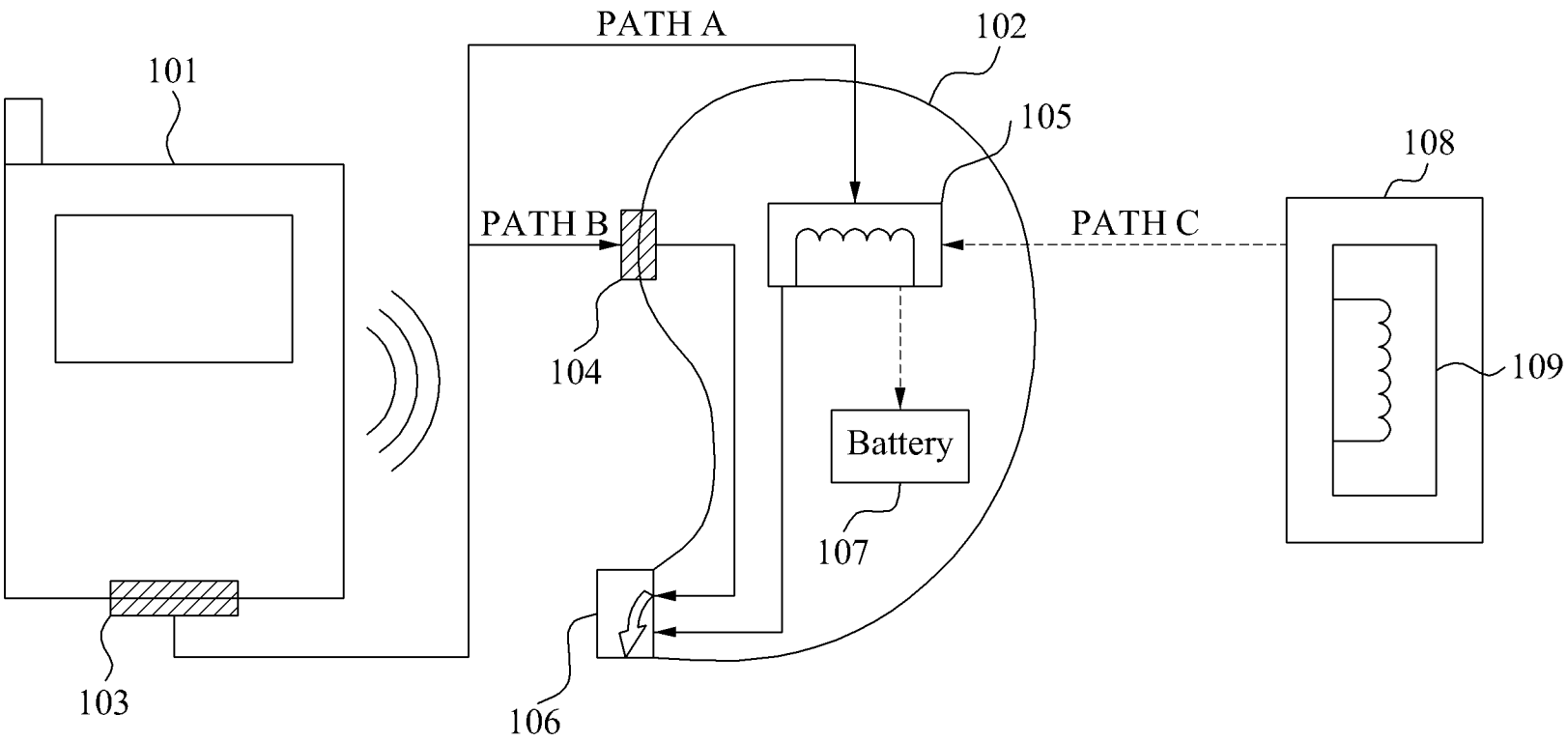
FIG. 1 is a diagram illustrating an example of a hearing apparatus.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

Throughout the drawings and the detailed description, the same reference numerals refer to the same elements. The drawings may not be to scale, and the relative size, proportions, and depiction of elements in the drawings may be exaggerated for clarity, illustration, and convenience.

FIG. 1 is a diagram illustrating an example of a hearing apparatus 102. Referring to FIG. 1, the hearing apparatus 102 in this example includes a microphone 104, a coil 105, a speaker 106, and a battery 107.

The hearing apparatus 102 may communicate with a wireless communication terminal 101 or charge the battery 107. The hearing apparatus 102 may transmit a phone sound of the wireless communication terminal 101. The hearing apparatus 102 may transmit the phone sound of the wireless communication terminal 101 to a hearing loss patient through a path A or a path B. That is, the hearing apparatus 102 may perform a phone sound transmitting function.

In greater detail, when using the path A, the hearing apparatus 102 may detect a change in a current of a speaker 103 of the wireless communication terminal 101, and transmit the phone sound using a current induction method. The phone sound transmitted by the current induction method may be transmitted to the hearing loss patient through the speaker 106.

The wireless communication terminal 101 may be presumed to be located at a relatively short distance from the hearing apparatus 102. In this case, the coil 105 may perform a same function as a telecoil.

When using the path B, the hearing apparatus 102 may receive the phone sound generated by the speaker 103 of the wireless communication terminal 101 through the microphone 104, and transmit the phone sound to the hearing loss patient through the speaker 106. That is, the hearing apparatus 102 may transmit the phone sound of the wireless communication terminal 101 to the hearing loss patient using an acoustic method.

The hearing apparatus 102 may be wirelessly supplied with power from a power supply device 108 through a path C. In greater detail, the power may be supplied wirelessly using the current induction method or a resonance method between the coil 105 of the hearing apparatus 102 and a coil 109 of the power supply device 108. As another example, the hearing apparatus 102 may be wirelessly supplied with power from the wireless communication terminal 101 instead of or in addition to the power supply device 108. In greater detail, the power may be supplied wirelessly using the current induction method or the resonance method between a coil (not shown) of the wireless communication terminal 101 and the coil 105 of the hearing apparatus 102.

That is, the coil 105 included in the hearing apparatus 102 may perform both phone sound transmission and wireless charging with respect to the wireless communication terminal 101, and may perform wireless charging with respect to the power supply device 108. For this purpose, the hearing apparatus 102 may include a structure enabling switching between two operation modes of the coil 105.

Figure 2:
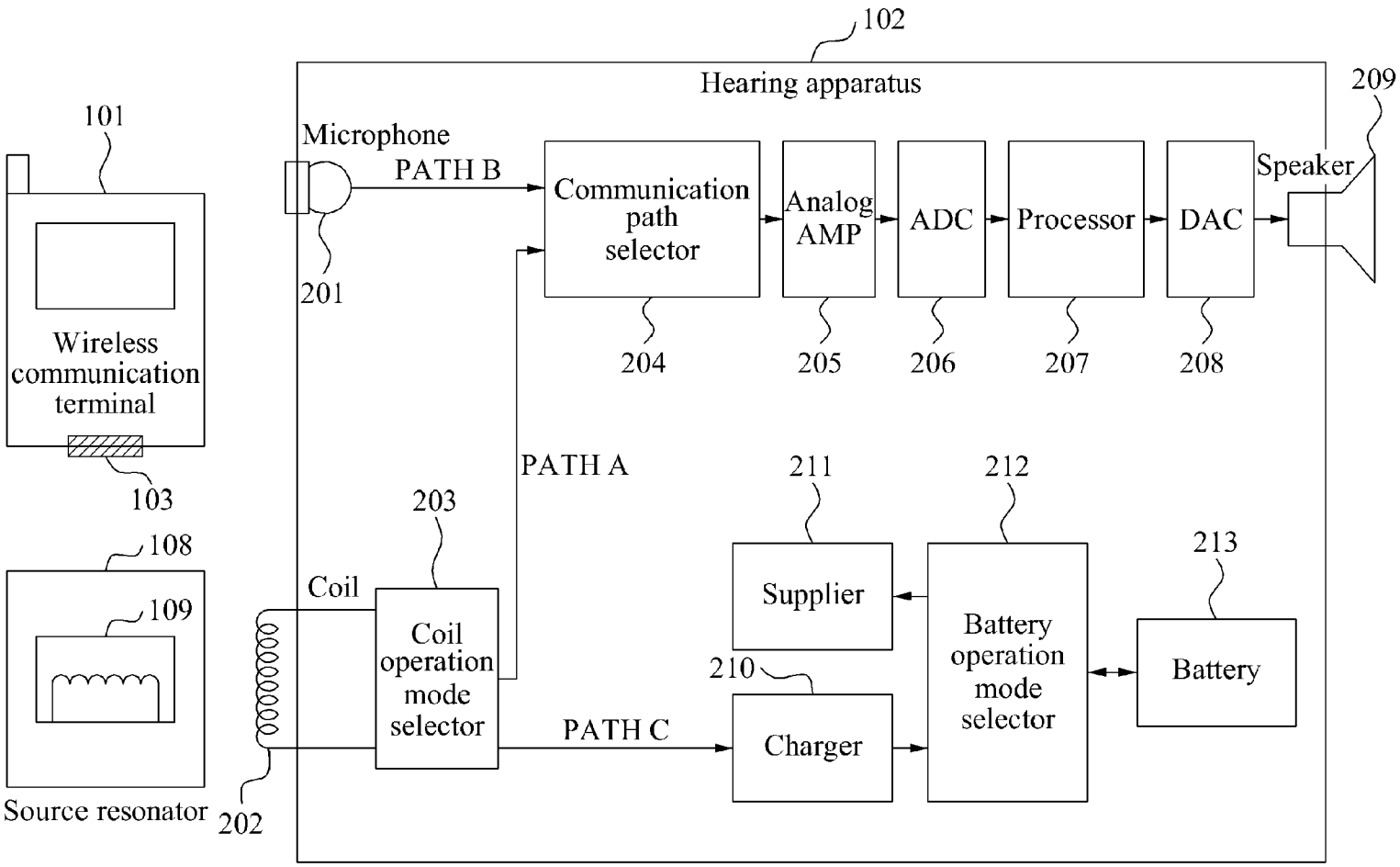
FIG. 2 is a diagram illustrating an example of a detailed structure of a hearing apparatus.

FIG. 2 is a diagram illustrating an example of a detailed structure of the hearing apparatus 102. Referring to FIG. 2, the hearing apparatus 102 in this example includes a microphone 201, a coil 202, a coil operation mode selector 203, a communication path selector 204, an analog amplifier (AMP) 205, an analog-to-digital converter (ADC) 206, a processor 207, a digital-to-analog converter (DAC) 208, a speaker 209, a charger 210, a supplier 211, a battery operation mode selector 212, and a battery 213. The coil operation mode selector 203, the communication path selector 204, and the battery operation mode selector 212 may be implemented using a switching circuit, for example.

The coil operation mode selector 203 may select between a first coil operation mode for communicating with the wireless communication terminal 101, and a second coil operation mode for wirelessly charging the battery 212. When the first operation mode is selected, a current is induced in the coil 202 according to a change in a current in the speaker 103 of the wireless communication terminal 101.

The communication path selector 204 may select between a first communication path for transmitting the phone sound of the wireless communication terminal 101 through the coil 202 using the current induction method, and a second communication path for transmitting the phone sound of the wireless communication terminal 101 through the microphone 201 using the acoustic method.

The battery operation mode selector 212 may select between a first battery operation mode for charging the battery 213 of the hearing apparatus 102 through the charger 210, and a second battery operation mode for supplying power to the supplier 211 by discharging the battery 213.

When the hearing apparatus 102 transmits the phone sound of the wireless communication terminal 101 using the current induction method as in a Case 1, the coil operation mode selector 203 selects the first coil operation mode and the communication path selector 204 selects the first communication path. Accordingly, the coil 202 may detect the change in the current in the speaker 103 of the wireless communication terminal 101 and a current may be induced in the coil 202. A current signal generated by the current induction may be amplified by the analog AMP 205, converted into a digital signal by the ADC 206, processed by the processor 207, converted into an analog signal by the DAC 208, and then transmitted to the hearing loss patient as the phone sound through the speaker 209.

When the hearing apparatus 102 wirelessly charges the battery 213 as in a Case 2, the coil operation mode selector 203 selects the second coil operation mode and the battery operation mode selector 212 selects the first battery operation mode.

The coil 202 may be supplied with power from the coil 109 of the power supply device 108 or the coil (not shown) included in the wireless communication terminal 101 by the current induction method or the resonance method.

When the hearing apparatus 102 transmits the phone sound of the wireless communication terminal 101 through the microphone 201 as in a Case 3, the communication path selector 204 selects the second communication path. Therefore, the phone sound of the wireless communication terminal 101 transmitted through the microphone 201 is an audio signal. The audio signal may be amplified by the analog AMP 205, converted into a digital signal by the ADC 206, processed by the processor 207, converted into an analog signal by the DAC 208, and then transmitted to the hearing loss patient as the phone sound through the speaker 209.

When the hearing apparatus 102 discharges the battery 213 and supplies power to the supplier 211 as in a Case 4, the battery operation mode selector 212 selects the second battery operation mode. In this case, the battery 213 may supply power to the supplier 211, and the supplier 211 supplies power to the hearing apparatus 102.

That is, the coil 202 included in the hearing apparatus 102 of FIG. 2 may perform either one of a wireless charging function and a phone sound transmission function selected by switching. Therefore, the hearing apparatus 102 does not need to be provided with both a coil for the wireless charging function and a separate coil for the phone sound transmission function. Accordingly, a size of the hearing apparatus 102 may be reduced. Furthermore, since an additional coil is not necessary, a material cost of the hearing apparatus 102 may be reduced.

Figure 3:
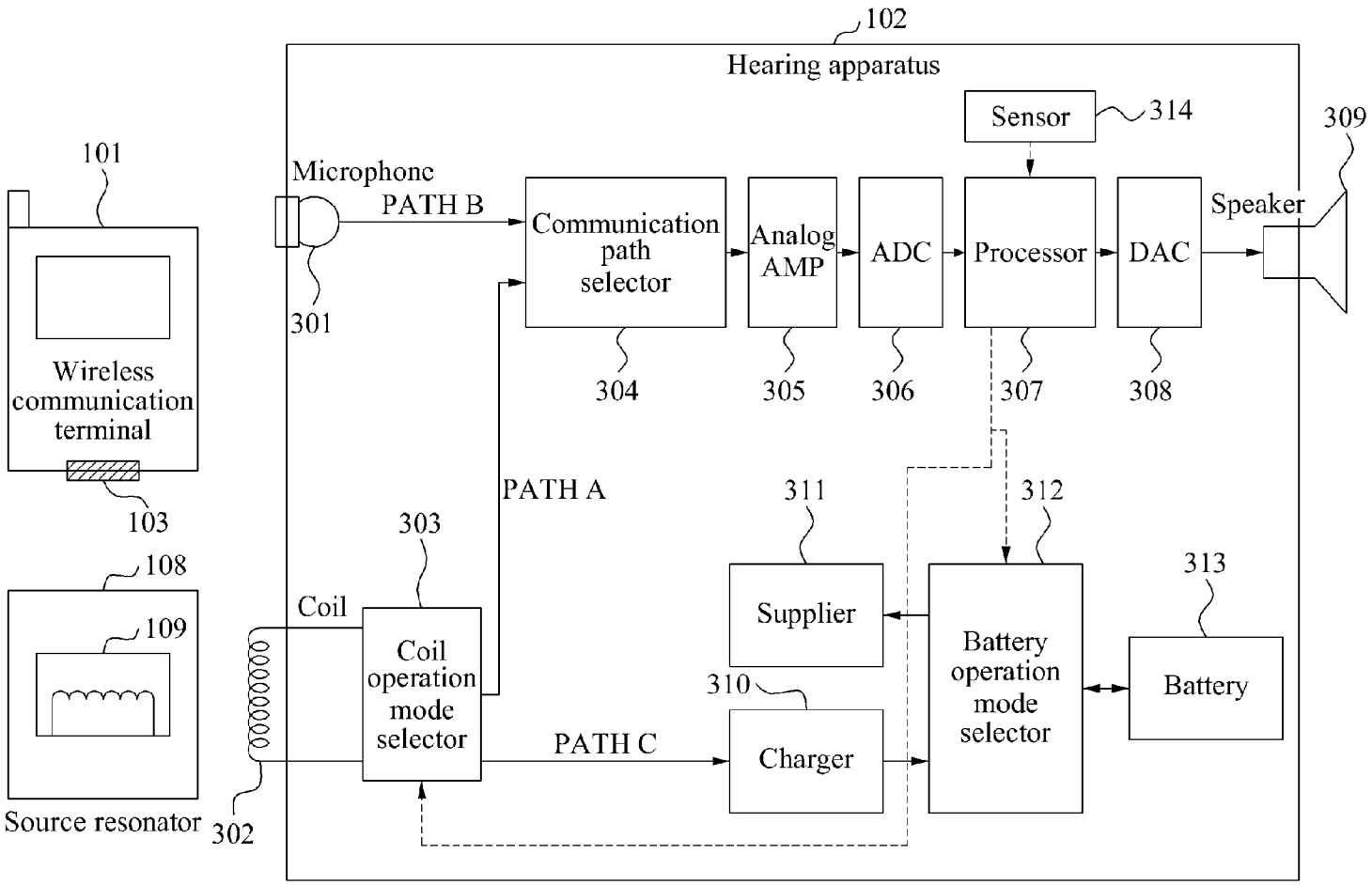
FIG. 3 is a diagram illustrating another example of a detailed structure of a hearing apparatus.

FIG. 3 is a diagram illustrating another example of a detailed structure of the hearing apparatus 102. Referring to FIG. 3, the hearing apparatus 102 in this example includes a microphone 301, a coil 302, a coil operation mode selector 303, a communication path selector 304, an analog AMP 305, an ADC 306, a processor 307, a DAC 308, a speaker 309, a charger 310, a supplier 311, a battery operation mode selector 312, a battery 313, and a sensor 314. The coil operation mode selector 303, the communication path selector 304, and the battery operation mode selector 312 may be implemented using a switching circuit, for example.

The coil operation mode selector 303, the communication path selector 304, and the battery operation mode selector 312 may operate in the same manner as the coil operation mode selector 203, the communication path selector 204, and the battery operation mode selector 211 described with reference to FIG. 2.

However, in this example, the processor 307 may provide a control signal for controlling the coil operation mode selector 303 and the battery operation mode selector 312. For example, when an external switch for charging the hearing apparatus 102 is operated by the user, the processor 307 may generate a control signal to control the coil operation mode selector 303 to select the second coil operation mode for wirelessly charging the battery 313, and to control the battery operation mode selector 312 to select the first battery operation mode for charging the battery 313 of the hearing apparatus 102 through the charger 310.

When the power supply device 108 begins operating, the processor 307 may receive a signal indicating that wireless charging of the battery 313 is to be performed through the coil 302 or a wireless communication unit included in the power supply device 108. Therefore, the processor 307 may generate a control signal to control the coil operation mode selector 303 to select the second coil operation mode.

In addition, the sensor 314 may determine whether the hearing apparatus 102 has remained motionless for a predetermined time using an acceleration sensor or a gyro sensor or any other sensor known to one of ordinary skill in the art capable of detecting whether the hearing apparatus 102 has remained motionless for the predetermined time. When the hearing apparatus 102 has remained motionless for a predetermined time, it may be presumed that the user is no longer wearing the hearing apparatus 102 and has laid the hearing apparatus 102 down to be charged, and the sensor 314 may transmit the signal indicating that wireless charging of the battery 313 is to be performed to the processor 307. Accordingly, the processor 307 may generate the control signal to control the coil operation mode selector 303 to select the second coil operation mode.

Figure 4:
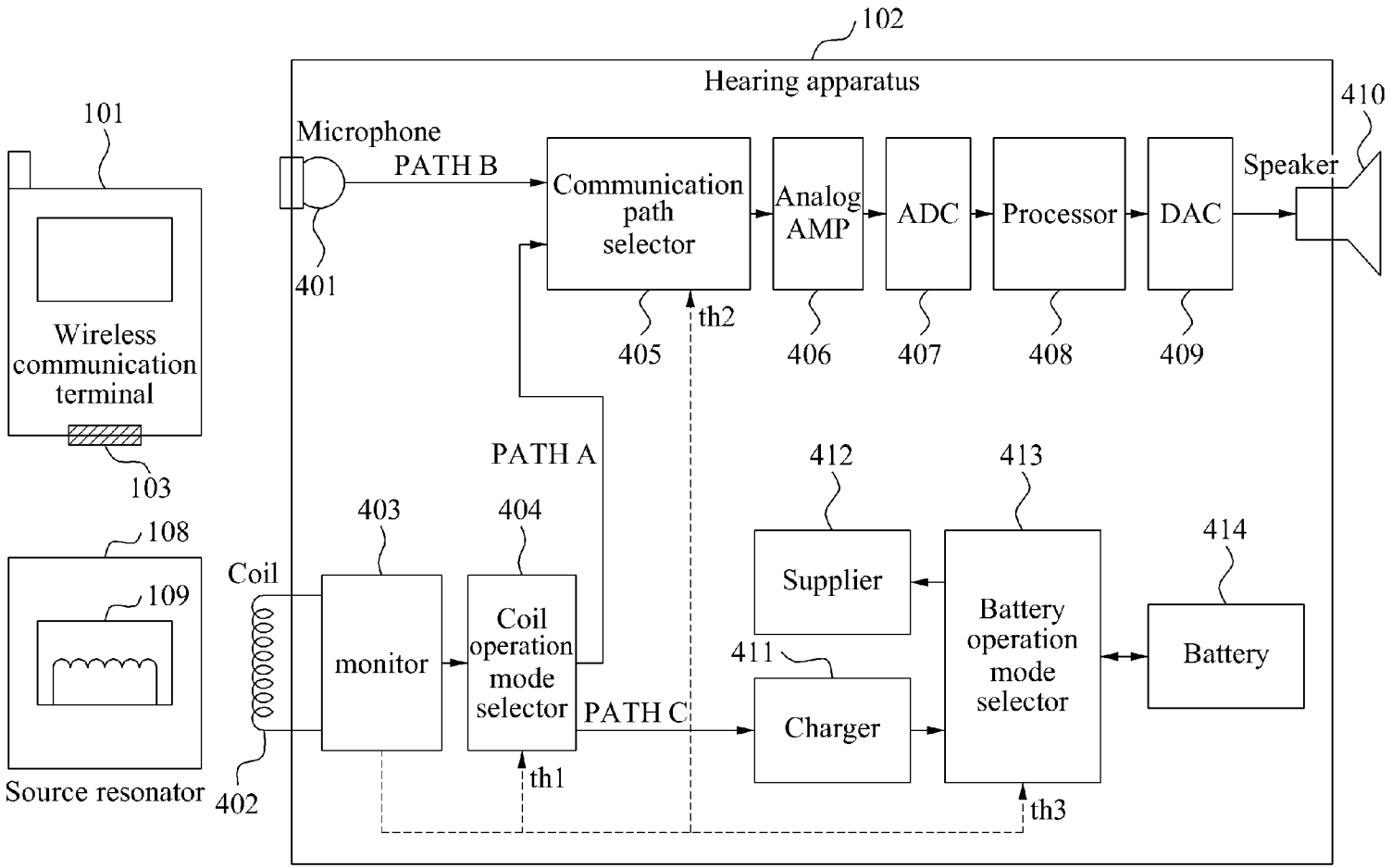
FIG. 4 is a diagram illustrating another example of a detailed structure of a hearing apparatus.

FIG. 4 is a diagram illustrating another example of a detailed structure of the hearing apparatus 102. Referring to FIG. 4, the hearing apparatus 102 in this example includes a microphone 401, a coil 402, a monitor 403, a coil operation mode selector 404, a communication path selector 405, an analog AMP 406, an ADC 407, a processor 408, a DAC 409, a speaker 410, a charger 411, a supplier 412, a battery operation mode selector 413, and a battery 414. The coil operation mode selector 404, the communication path selector 405, and the battery operation mode selector 413 may be implemented using a switching circuit, for example.

The coil operation mode selector 404, the communication path selector 405, and the battery operation mode selector 413 may operate in the same manner as the coil operation mode selector 203, the communication path selector 204, and the battery operation mode selector 211 described with reference to FIG. 2.

The monitor 403 determines whether a current signal generated from the coil 402 by amplifying a current signal generated in the coil 402 is induced by a change in the current of the speaker 103 of the wireless communication terminal 101, or is transmitted from the coil (not shown) of the wireless communication terminal 101 or the coil 109 of the power supply device 108.

For example, the monitor 403 may compare the current signal generated from the coil 402 with a first reference value th1 for selecting the coil operation mode, a second reference value th2 for selecting the communication path, and a third reference value th3 for selecting the battery operation mode. The coil operation mode selector 404 may select the path A corresponding to the first coil operation mode for communicating with the wireless communication terminal 101 or the path C corresponding to the second coil operation mode for wirelessly charging the battery 414 based on a result of comparing the current signal with the first reference value th1. The communication path selector 405 may select the path A for transmitting the phone sound of the wireless communication terminal 101 using the current induction method or the path B for transmitting the phone sound of the wireless communication terminal 101 using the acoustic method based on a result of comparing the current signal with the second reference value th2. The battery operation mode selector 413 may select the first battery operation mode for charging the battery 414 through the charger 411 or the second battery operation mode for supplying power to the supplier 412 by discharging the battery 414 based on a result of comparing the current signal with the third reference value th3.

Figure 5:
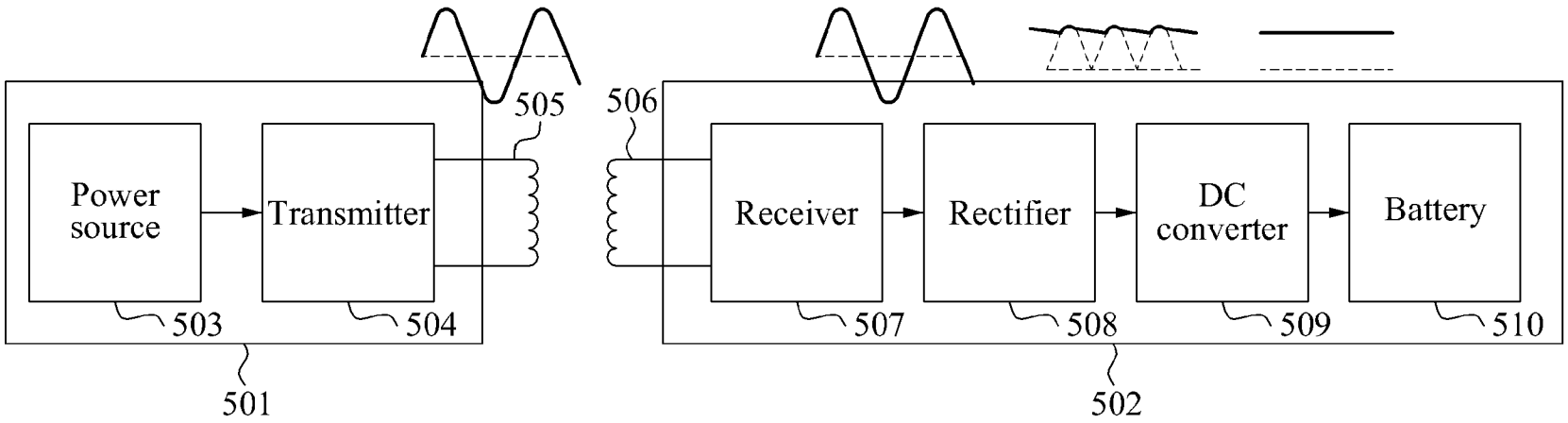
FIG. 5 is a diagram illustrating an example of a wireless charging method using a current induction method.

FIG. 5 is diagram illustrating an example of a wireless charging method using a current induction method. Referring to FIG. 5, a power supply device 501 transmits power from a power source 503 to a transmitter 504. The transmitter 504 wirelessly transmits power from a coil 505 of the power supply device 501 to a coil 506 of a hearing apparatus 502 using the current induction method. Therefore, the current flowing through the coil 505 may also flow through the coil 506 as a result of the current induction.

The current transmitted to the coil 506 using the current induction method is received by a receiver 507 and transmitted to a rectifier 508 of the hearing apparatus 502. The rectifier 508 rectifies the current supplies the rectified current to a direct current (DC) converter 509. The DC converter 509 converts the rectified current to a DC voltage and supplies the DC voltage to a battery 510 to charge the battery 510. Thus, the battery 510 may be charged by a wireless power transmission method using the current induction method.

Although not shown in FIG, 5, the coil 506 is presumed to be switched to a coil operation mode for performing the wireless charging function. The power supply device 501 of FIG. 5 may correspond to the wireless communication terminal 101 or the power supply device 108 of FIG. 1.

Figure 6:
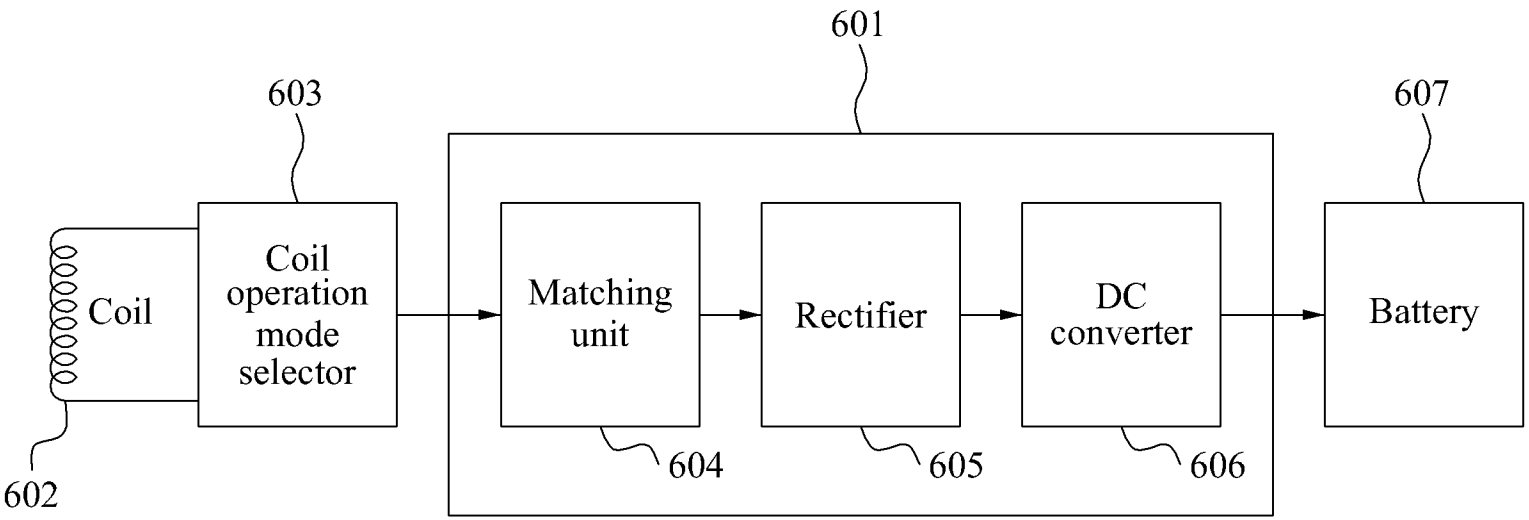
FIG. 6 is a diagram illustrating an example of a wireless charging method using a resonance method.

FIG. 6 is a diagram illustrating an example of a wireless charging method using a resonance method. A coil operation mode selector 603 selects a coil operation mode for the coil 506 to perform the wireless charging function. Therefore, a coil 602 may generate a current using the resonance method.

A matching unit 604 performs impedance matching so that resonance occurs between the coil 602 and a coil (not shown) of a power supply device, such as the coil 505 of the power supply device 501 of FIG. 5, causing a current to flow through the coil 602 due to the resonance. The matching unit 604 may adjust an inductance and a capacitance of the matching unit 604 based on a function related to a size of the coil 602 and a number of turns of the coil 602 to enable the resonance to occur. A rectifier 605 rectifies the current flowing through the coil 602 and passing through the matching unit 604 and supplies the rectified current to a DC converter 606. The DC converter converts the rectified current to a DC voltage and supplies the DC voltage to a battery 607 to charge the battery 607. Thus, the battery 607 may be charged by a wireless power transmission method using the resonance method.

Figure 7:
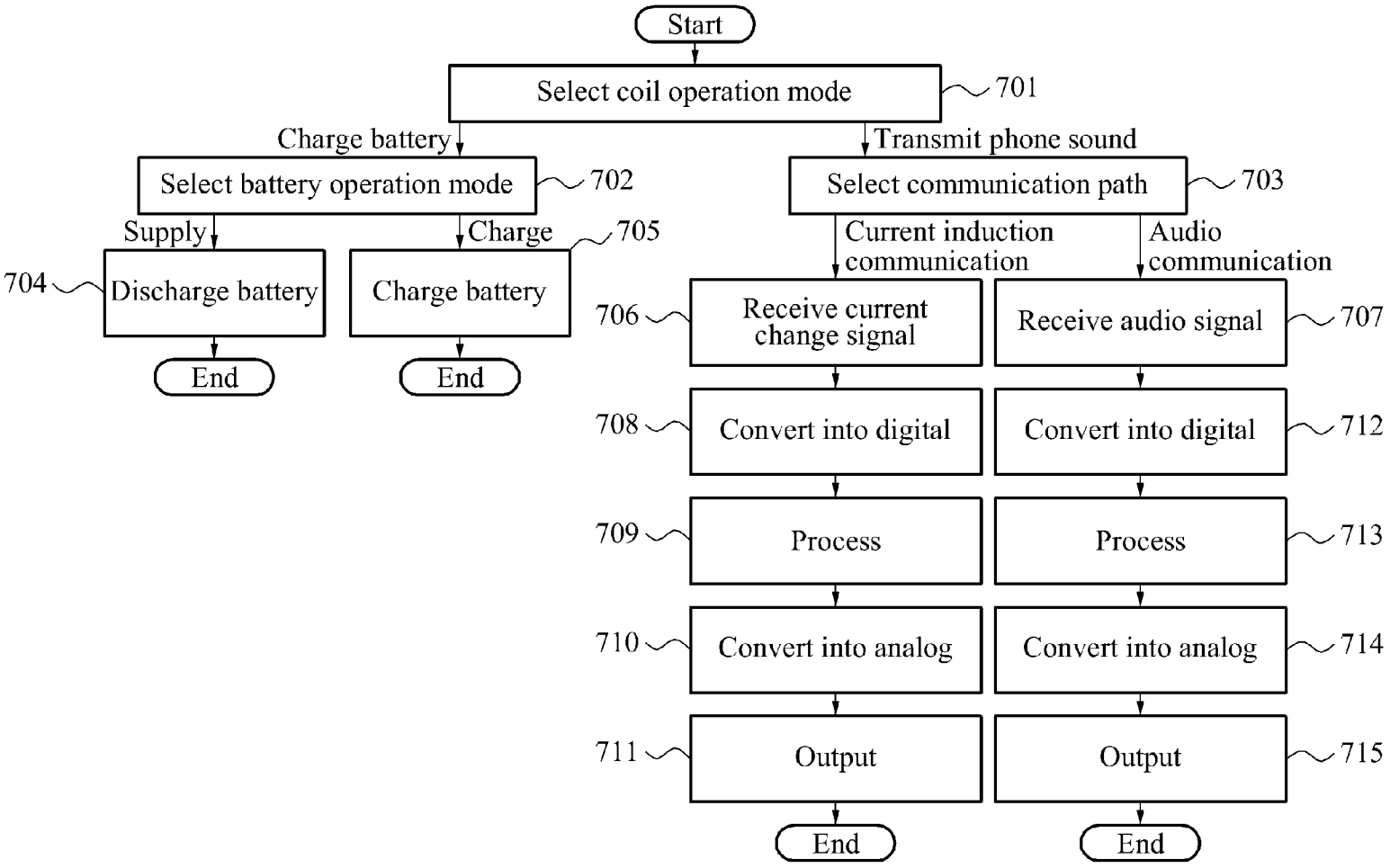
FIG. 7 is a flowchart illustrating an example of operation of a hearing apparatus.

FIG. 7 is a flowchart illustrating an example of operation of a hearing apparatus. In operation 701, the hearing apparatus selects a coil operation mode. The hearing apparatus may select a coil operation mode for charging a battery, or a coil operation mode for transmitting a phone sound of a wireless communication terminal.

When the hearing apparatus selects the coil operation mode for charging the battery in operation 701, the hearing apparatus selects a battery operation mode in operation 702.

When the hearing apparatus selects the battery operation mode for supplying power to the hearing apparatus by discharging the battery in operation 702, the hearing apparatus discharges the battery in operation 704. When the hearing apparatus selects the battery operation mode for charging the battery in operation 702, the hearing apparatus charges the battery in operation 705.

When the hearing apparatus selects the coil operation mode for transmitting the phone sound of the wireless communication terminal in operation 701, the hearing apparatus selects a communication path in operation 703. When the hearing apparatus selects a communication path for current induction communication in operation 703, the hearing apparatus receives a current change signal of a speaker of the wireless communication terminal in operation 706.

In operation 708, the hearing apparatus converts the current change signal into a digital current change signal. In operation 709, the hearing apparatus processes the digital current change signal, for example, by amplifying the digital current change signal. The hearing apparatus converts the processed digital current change signal into a processed analog current change signal in operation 710, and outputs the processed analog current change signal through a speaker of the hearing apparatus in operation 711.

When the hearing apparatus selects the communication path for acoustic communication in operation 703, the hearing apparatus receives an audio signal generated by the speaker of the wireless communication terminal in operation 707. The hearing apparatus converts the audio signal into a digital audio signal in operation 712, and processes the digital audio signal, for example, by amplifying the digital audio signal, in operation 713. The hearing apparatus converts the processed digital audio signal into a processed analog audio signal in operation 714, and outputs the processed analog audio signal through the speaker of the hearing apparatus in operation 715.

The coil operation mode selectors 204, 303, 404, and 603, the communication path selectors 204, 304, and 405, the processors 207, 307, and 408, the battery mode selectors 212, 312, and 413, and the monitor 403 described above that perform the operations illustrated in FIG. 7 may be implemented using one or more hardware components, one or more software components, or a combination of one or more hardware components and one or more software components.

A hardware component may be, for example, a physical device that physically performs one or more operations, but is not limited thereto. Examples of hardware components include resistors, capacitors, inductors, power supplies, frequency generators, operational amplifiers, power amplifiers, low-pass filters, high-pass filters, band-pass filters, analog-to-digital converters, digital-to-analog converters, and processing devices.

A software component may be implemented, for example, by a processing device controlled by software or instructions to perform one or more operations, but is not limited thereto. A computer, controller, or other control device may cause the processing device to run the software or execute the instructions. One software component may be implemented by one processing device, or two or more software components may be implemented by one processing device, or one software component may be implemented by two or more processing devices, or two or more software components may be implemented by two or more processing devices.

A processing device may be implemented using one or more general-purpose or special-purpose computers, such as, for example, a processor, a controller and an arithmetic logic unit, a digital signal processor, a microcomputer, a field-programmable array, a programmable logic unit, a microprocessor, or any other device capable of running software or executing instructions. The processing device may run an operating system (OS), and may run one or more software applications that operate under the OS. The processing device may access, store, manipulate, process, and create data when running the software or executing the instructions. For simplicity, the singular term "processing device" may be used in the description, but one of ordinary skill in the art will appreciate that a processing device may include multiple processing elements and multiple types of processing elements. For example, a processing device may include one or more processors, or one or more processors and one or more controllers. In addition, different processing configurations are possible, such as parallel processors or multi-core processors.

A processing device configured to implement a software component to perform an operation A may include a processor programmed to run software or execute instructions to control the processor to perform operation A. In addition, a processing device configured to implement a software component to perform an operation A, an operation B, and an operation C may have various configurations, such as, for example, a processor configured to implement a software component to perform operations A, B, and C; a first processor configured to implement a software component to perform operation A, and a second processor configured to implement a software component to perform operations B and C; a first processor configured to implement a software component to perform operations A and B, and a second processor configured to implement a software component to perform operation C; a first processor configured to implement a software component to perform operation A, a second processor configured to implement a software component to perform operation B, and a third processor configured to implement a software component to perform operation C; a first processor configured to implement a software component to perform operations A, B, and C, and a second processor configured to implement a software component to perform operations A, B, and C, or any other configuration of one or more processors each implementing one or more of operations A, B, and C. Although these examples refer to three operations A, B, C, the number of operations that may implemented is not limited to three, but may be any number of operations required to achieve a desired result or perform a desired task.

Software or instructions for controlling a processing device to implement a software component may include a computer program, a piece of code, an instruction, or some combination thereof, for independently or collectively instructing or configuring the processing device to perform one or more desired operations. The software or instructions may include machine code that may be directly executed by the processing device, such as machine code produced by a compiler, and/or higher-level code that may be executed by the processing device using an interpreter. The software or instructions and any associated data, data files, and data structures may be embodied permanently or temporarily in any type of machine, component, physical or virtual equipment, computer storage medium or device, or a propagated signal wave capable of providing instructions or data to or being interpreted by the processing device. The software or instructions and any associated data, data files, and data structures also may be distributed over network-coupled computer systems so that the software or instructions and any associated data, data files, and data structures are stored and executed in a distributed fashion.

For example, the software or instructions and any associated data, data files, and data structures may be recorded, stored, or fixed in one or more non-transitory computer-readable storage media. A non-transitory computer-readable storage medium may be any data storage device that is capable of storing the software or instructions and any associated data, data files, and data structures so that they can be read by a computer system or processing device. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, or any other non-transitory computer-readable storage medium known to one of ordinary skill in the art.

Functional programs, codes, and code segments for implementing the examples disclosed herein can be easily constructed by a programmer skilled in the art to which the examples pertain based on the drawings and their corresponding descriptions as provided herein.

While this disclosure includes specific examples, it will be apparent to one of ordinary skill in the art that various modifications may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A hearing apparatus comprising:

a coil configured to receive a signal from a communication terminal, and further configured to receive power wirelessly transmitted from a power supply device;

a coil operation mode selector configured to select either a first coil operation mode for communicating with a wireless communication terminal, or a second coil operation mode for charging a battery of the hearing apparatus; and a sensor configured to sense recognition information indicating whether wireless charging of the hearing apparatus is to be performed.

2. The apparatus of claim 1, further comprising a communication path selector configured to select either a first communication path configured to transmit a phone sound of the wireless communication terminal using current induction, or a second communication path configured to transmit the phone sound of the wireless communication terminal using acoustic communication.

3. The hearing apparatus of claim 1, further comprising a battery operation mode selector configured to select either a first battery operation mode for charging the battery, or a second battery operation mode for discharging the battery.

4. The hearing apparatus of claim 1, wherein the coil is configured to generate a current using a current induction method or a resonance method in response to power wirelessly transmitted by a power supply device.

5. The hearing apparatus of claim 4, wherein the coil is configured to generate the current using the resonance method; and the hearing apparatus further comprises a charger configured to perform impedance matching to enable resonance to occur between the coil of the hearing apparatus and a coil of the power supply device.

6. The hearing apparatus of claim 1, further comprising a processor configured to generate a control signal to control the coil operation mode selector.

7. The hearing apparatus comprising:

a coil;

a coil operation mode selector configured to select either a first coil operation mode for communicating with a wireless communication terminal, or a second coil operation mode for wirelessly charging a battery of the hearing apparatus;

a processor configured to generate a control signal to control the coil operation mode selector; and a sensor configured to sense recognition information indicating whether wireless charging of the hearing apparatus is to be performed;

wherein the processor is further configured to generate the control signal based on the sensed recognition information.

8. The hearing apparatus of claim 7, wherein the recognition information indicates whether a charging control of the hearing apparatus has been manually actuated.

9. The hearing apparatus of claim 7, wherein the recognition information indicates whether a power supply device configured to wirelessly supply power to the hearing apparatus is operating.

10. The hearing apparatus of claim 7, wherein the recognition information indicates whether the hearing apparatus has remained motionless for a predetermined time.

11. The hearing apparatus of claim 1, further comprising a monitor configured to generate a control signal to control the coil operation mode selector based on a current signal generated by the coil.

12. The hearing apparatus of claim 11, wherein the monitor is further configured to generate the control signal based on a reference value for distinguishing whether the current signal is a current signal for transmitting a phone sound, or a current signal for charging the battery.

13. The hearing apparatus of claim 7, further comprising:

a communication path selector configured to select either a first communication path configured to transmit a phone sound of the wireless communication terminal using current induction, or a second communication path configured to transmit the phone sound of the wireless communication terminal using acoustic communication; and a battery operation mode selector configured to select either a first battery operation mode for charging the battery, or a second battery operation mode for discharging the battery.

14. The hearing apparatus of claim 7, wherein the coil is configured to generate a current using a current induction method or a resonance method in response to power wirelessly transmitted by a power supply device.

15. The hearing apparatus of claim 14, wherein the coil is configured to generate the current using the resonance method; and the hearing apparatus further comprises a charger configured to perform impedance matching to enable resonance to occur between the coil of the hearing apparatus and a coil of the power supply device.

16. An apparatus comprising:

a coil configured to receive a signal from a communication terminal, and further configured to receive power wirelessly transmitted from a power supply device;

a mode selector configured to select either a communicating mode for communicating using the coil, or a charging mode for charging using the coil; and a sensor configured to sense recognition information indicating whether wireless charging of the apparatus is to be performed.

17. The apparatus of claim 16, wherein the coil is configured to generate a current signal in response to a current generated in a speaker of the communication terminal using a current induction method; and the apparatus further comprises:

a microphone configured to generate a current signal in response to an acoustic sound received from the speaker of the communication terminal; and a path selector configured to select either the current signal generated by the coil, or the current signal generated by the microphone.

18. The apparatus of claim 16, wherein the coil is configured to receive power wirelessly transmitted from the power supply device using a current induction method or a resonance method; and the apparatus further comprises:

a battery; and a charger configured to receive charge the battery with the power received by the coil.

19. The apparatus of claim 18, further comprising:

a supplier configured to receive power from the battery and supply the received power to the apparatus; and a mode selector configured to select either a charging mode in which the charger is connected to the battery to charge the battery, or a discharging mode in which the supplier is connected to the battery to discharge the battery by supplying the received power to the apparatus.

* * * * *